United States Patent [19]

Urban, deceased

[11] 4,037,799

[45] July 26, 1977

[54] PORTABLE HAMMERMILL AND ATTACHED INCLINED AUGERED FEED TABLE

[75] Inventor: Guy K. Urban, deceased, late of Lancaster, Pa., by Mary Urban, administratrix/executrix

[73] Assignee: Feedmobile, Inc., Lititz, Pa.

[21] Appl. No.: 573,026

[22] Filed: Apr. 30, 1975

[51] Int. Cl.[2] ..... B02C 13/286

[52] U.S. Cl. ..... 241/186 A; 241/73; 241/101.7

[58] Field of Search ..... 241/73, 101.7, 186 A

[56] References Cited

U.S. PATENT DOCUMENTS

| | | | |
|---|---|---|---|
| 2,711,964 | 6/1955 | Wiemer | 241/186 A |
| 2,833,485 | 5/1958 | Rothhaar | 241/186 A |
| 3,146,960 | 9/1964 | De Graff | 241/101.7 |
| 3,194,288 | 7/1965 | Dodgen et al. | 241/101.7 X |
| 3,700,179 | 10/1972 | Van Peursem | 241/186 A |
| 3,771,733 | 11/1973 | Hadley et al. | 241/73 |
| 3,964,720 | 6/1976 | Most | 241/186 A |

*Primary Examiner*—Granville Y. Custer, Jr.
*Attorney, Agent, or Firm*—Lackenbach, Lilling & Siegel

[57] ABSTRACT

An improved hammermill having a housing defining a grinding chamber and having a rotor employing a plurality of swinging hammers. A twin augered feed table having troughs in its bottom supports counter-rotating augers which feed the material to be processed directly upwardly at an angle into the rotor and faces of the hammers.

10 Claims, 8 Drawing Figures

3
4
5
6
16
18
20
22
24
26
28
30
31
36
38
40
44
52
54
55
56
57
59
60
64
66
68
69
70
72
74
76
78
82
84
85
86
88
89
90
92
100
102
106
116
118
124
126
128
130
132
134
136
138
140
156

PORTABLE HAMMERMILL AND ATTACHED INCLINED AUGERED FEED TABLE

BACKGROUND OF THE INVENTION

This application and an application filed concurrently herewith and entitled "PORTABLE HAMMERMILL AND ATTACHED IN-LINE FEED TABLE," Ser. No. 573,025, are owned by a common assignee.

Although numerous types of hammermills are used in the agricultural industry, and many apparatus are widely marketed, there is a general desire for a smaller, compact, more efficient machine capable of performing all of the same feed grinding requirements generally accustomed to by the former, but with a better arrangement of elements and a more simple structure or construction.

For example, heretofore in the art, the hammermills fed the material to be processed directly into the side or center portion of a rotor or through a top opening therein or other downwardly directed chute or conveyor structure connected to the rotor. None, however, fed the material directly into the face of the rotor or the hammers by means of at least one pair of counter-rotating augers disposed in an inclined trough. Typical of some of the prior art hammermills are shown and described in U.S. Pat. Nos. 1,416,065; 2,501,911; 2,590,056; 2,927,740; 3,062,461; 3,101,759; 3,129,739; 3,436,028 and 3,771,733.

Many of such devices employ chain operated feed tables in contrast to the augered feed table described herein and forming a part of the present invention. Another device currently available in the trade is known as an Allied, "Tuffy" portable mill-mixer. This unit employs a triple auger feed table having three 4 inches augers which all rotate in the same direction and the augers feed the material into the central portion of the rotor. Such apparatus is manufactured by the Allied Farm Equipment Co. of Chicago, Ill. and St. Marys, Ontario, Canada.

Accordingly, it is a primary object of this invention to provide an improved hammermill apparatus having an augered feed table which feeds the material to be processed directly into the face of the rotor and the swinging hammers, the auger feed table being inclined at an acute angle with the feed table.

It is another object of the invention to provide a unique auger feed table, wherein at least one pair of augers is disposed side by side and counter rotate toward each other and toward the center of the feed table.

It is a further object of the invention to provide an apparatus having a grinding chamber and a twin auger feed table which feeds the material upwardly at an incline or acute angle into the hammermill.

It is yet a further object of the invention to provide a novel and improved hammermill having the advantageous characteristics mentioned in the preceding paragraphs, which is relatively simple in construction so as to be capable of economic manufacture by mass production techniques.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figures 1, 8:
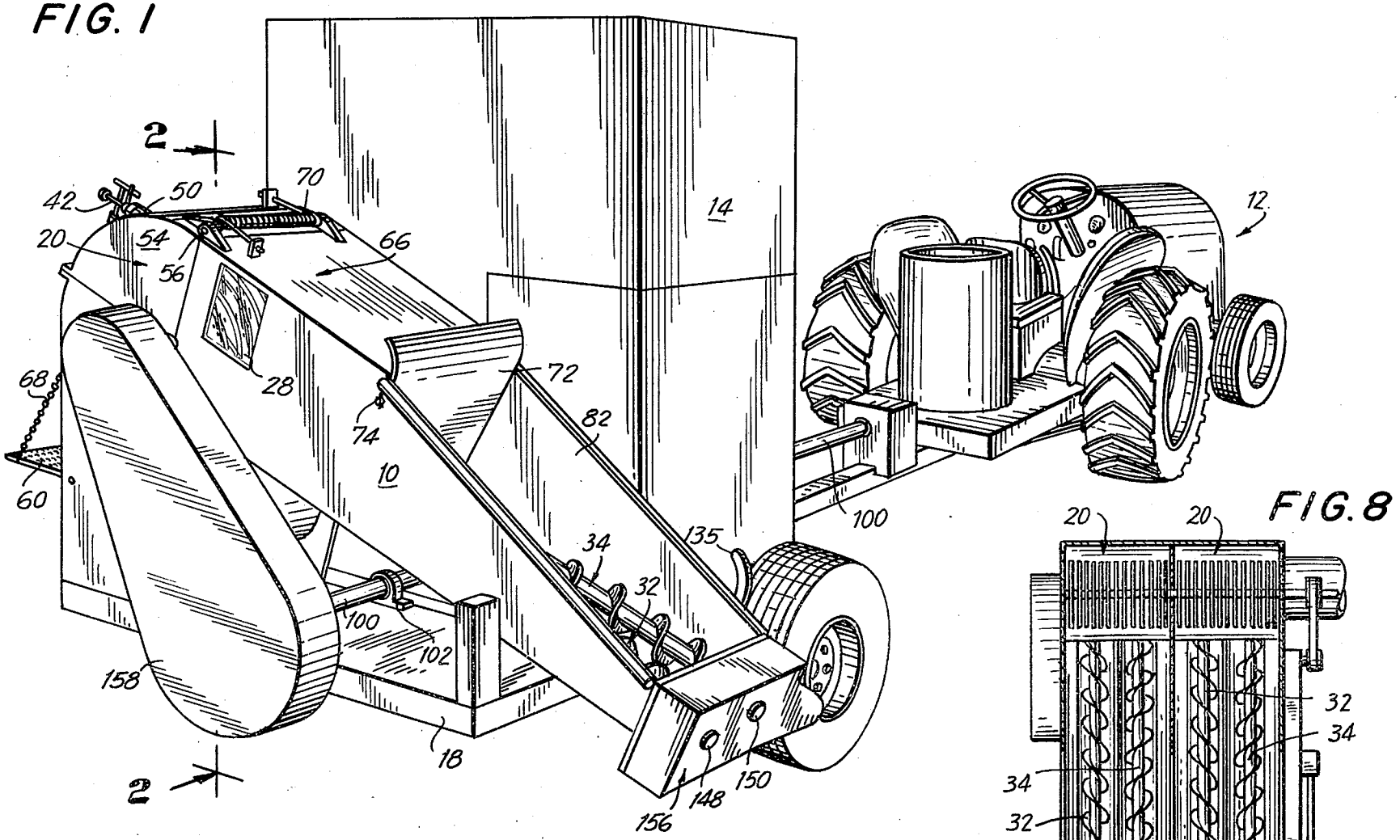
FIG. 1 is a perspective view of the improved portable hammermill connected to a tractor drive hook-up arrangement for powering and transporting same, and also showing disposed intermediate thereof a connecting feed grinder and mixer apparatus.
FIG. 8 is a sectional view, looking down into a modified apparatus having a pair of improved portable hammermills and twin auger feed tables mounted back to back.
Figure 2:
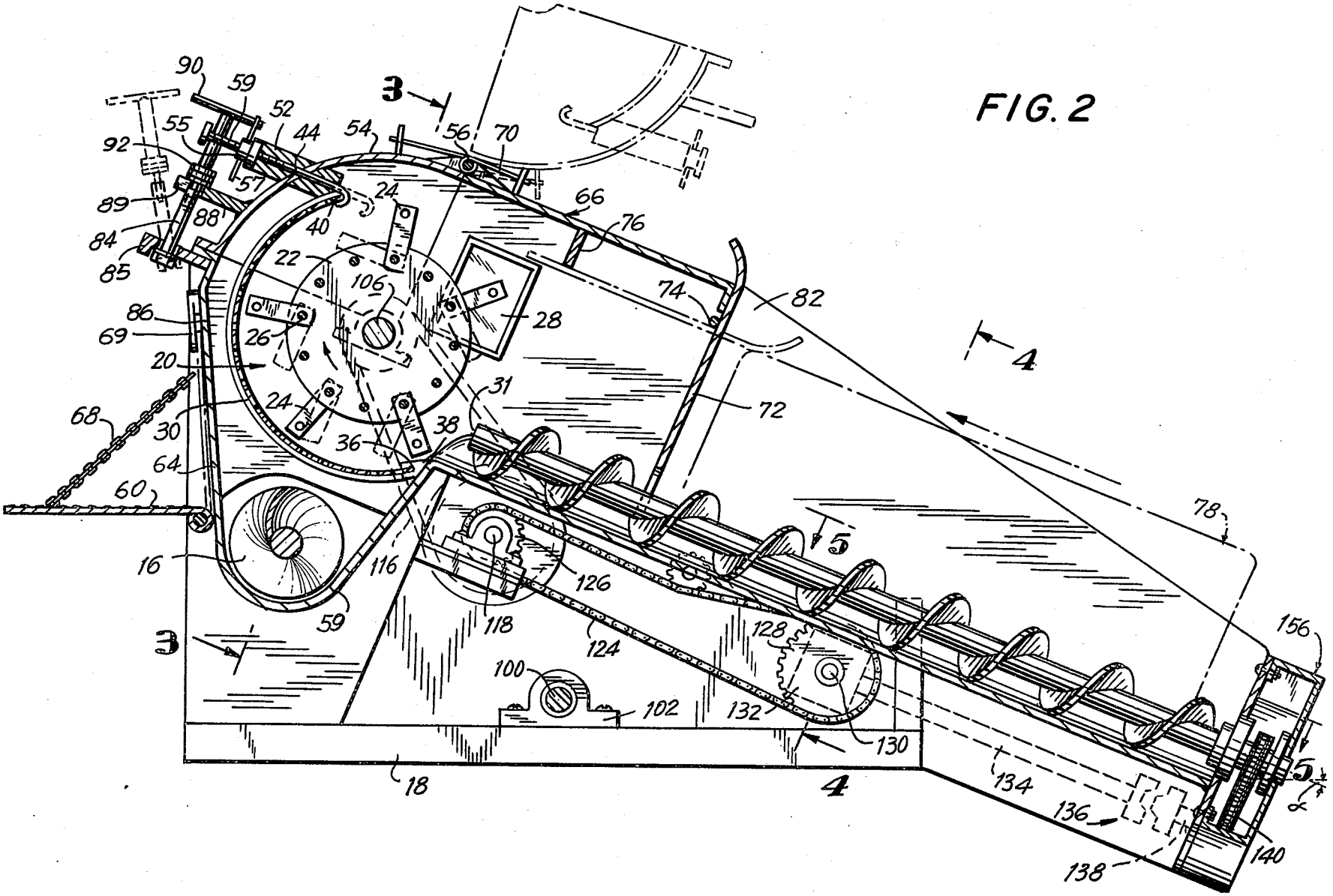
FIG. 2 is a sectional view generally taken along the line 2—2 of FIG. 1.
Figure 3:
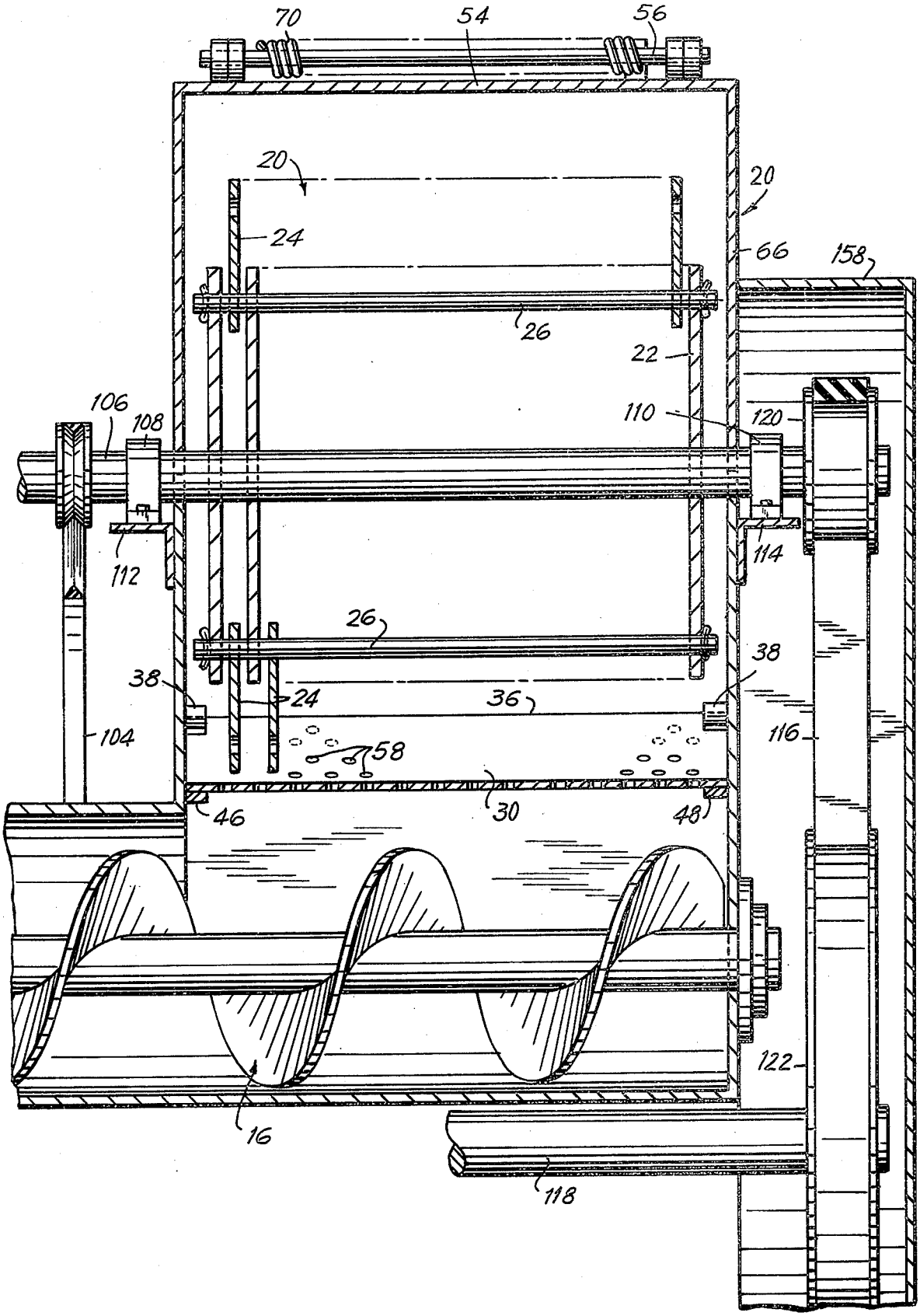
FIG. 3 is a sectional view generally taken through the hammermill and along the line 3—3 of FIG. 2.
Figure 4:
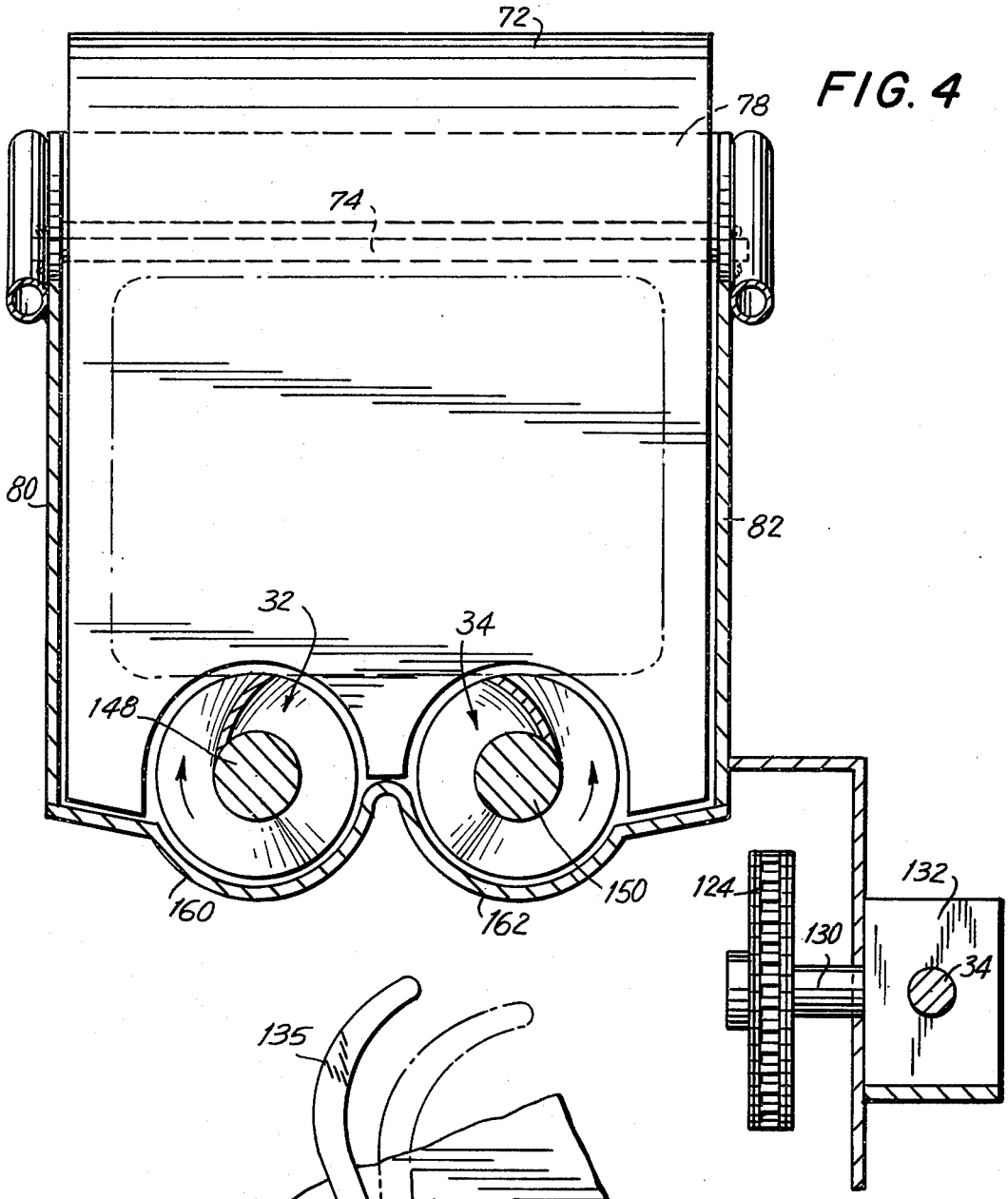
FIG. 4 is a sectional view, across the twin auger feed table looking toward the hinged door leading to the hammermill, taken along the line 4—4 of FIG. 2.

Referring now more particularly to the drawings, and specifically to FIGS. 1–3 thereof, an improved portable hammermill having an integrally attached twin augered feed table unit of the present invention is shown. The apparatus is there generally designated 10, and it is shown mechanically driven by a power take-off attachment extending from the rear of a tractor 12. Between the tractor 12 and the improved portable hammermill device 10 is a grinder/mixer apparatus 14, conventionally available in the market, such as a mixing tank having a vertical mixing auger for mixing and blending uniformly various feeds and supplements, generally with a molasses based liquid. This unit 14 does not form a part of the invention, but is merely shown only in FIG. 1 to illustrate that a horizontal discharge or transfer auger 16, as best shown in FIG. 3, for example, may be employed to move the processed feed, grain, or other material from accumulating beneath the hammermill to a next station or operation in handling the material.

The improved hammermill device or apparatus 10 is suitably conveniently mounted on a suitable platform member or frame 18 which may be fastened down as a stationary unit, or, as shown herein, it may be used as a portable unit. The hammermill portion 20 of the device 10 is generally of conventional construction and comprises a rotor having a series of parallel plates 22 and having pivoted hammers 24 and/or knives suspended between the plates from rods 26 extending through and secured to the plates 22. The plates 22 may be of basically any shape, such as square, pentagonal, etc. and are conveniently illustrated herein as circular or disc-like in form. One or more inspection windows 28 may be provided in the housing enclosing the hammermill portion 20 for viewing and observing or checking on the action of the hammermill in operation during use in grinding various types of grain, roughage or other material.

In this connection, it will be appreciated that the improved hammermill of the present invention operating at about 3,000 rpm with suitable governor control means is capable of handling and processing uniformly just about any material capable of being fed into the unit, such as even wood chunks or other waste scrap material, tin cans, cardboard, chocolate, refuse and generally garbage of any moisture or texture. In addition, ear corn, shelled corn, haylage, silage and baled hay are easily processed by the device of the invention. With respect to whole bales of hay, straw or other material, the apparatus of the present invention, in contrast with most other prior art machines, does not first require the bale to be sliced up or first shredded or otherwise broken up by a separate attachment prior to being fed into the hammermill.

The grinding surface or grate in the hammermill comprises a removable screen 30 of arcuate shape, generally of a cylindrical curvature corresponding to the path of travel of the pivoted and rotated hammers or combination of hammers and knives. This screen 30 covers about one-half of the mill's circumference, beginning just about beneath the free ends 31 of the twin counter rotating augers 32 and 34, and ending about 180° therefrom near the top of the hammermill. The end 36 of the screen 30 adjacent the free ends 31 of the augers 32, 32 is held fixedly in place to the bottom portion of the of the mill by means of a channel or grooved element 38, on at least the two corners or edges thereof. At the top end 40 of the screen 30, a pair of screen latch hooks 42 and 44 are employed to retain and lock the screen 30 firmly in place against the curved side bars or rails 46 and 48 against which the screen 30 rests and bears upon, as best shown in FIGS. 2 and 3. The screen may be of a greater circumference, but due to gravity which tends to cause the ground material to drop down from the top portion of the mill, a screen covering about half of the mill's circumference is most efficient.

The latch bars or latch hooks 42 and 44 are held in place and extend loosely through bored cylinder-like housing elements 50 and 52 which are generally secured, such as by welding to the hinged mill cover 54. Threaded nuts 55, having extending transverse handles 57, engage the threaded end 59 of the latch hooks 42 and 44 for tightening the curved free ends of the latch hooks which lock the screen 30 in place to the mill. The cover 54 is hinged or pivoted about a shaft 56, as in FIG. 2 which shows the full open position of the cover 54 in phantom. In this position, the screen can be removed and replaced with another, or the mill can be cleaned and/or otherwise inspected. As is conventional in the market, the apertures 58 in the screen, can vary from about, for example, $\frac{1}{8}$ inch diameter hole size to about 2 inches diameter hole. Of course, with very small diameter holes, the screens may be reinforced with a suitable open frame backing secured to the back side of the screen.

The hammers 24 grind and/or otherwise force the material through the holes in the screen, thereby providing a more uniform, and textured process material of generally the desired mix size required by the user. Upon the material passing through the screen 30, it falls down due to gravity and collects in the trough 59, and is suitably removed by means of the discharge or transfer auger 16. Of course, the processed material may be removed from collecting in the trough 59 beneath the hammermill by conveyor belt means or may even be vacuum removed or otherwise transferred by other suitable means.

A suitable access platform 60 pivoted about a shaft 62 secured to the far side 64 of the housing 66 enclosing the hammermill provides the means for enabling one to have quick and easy access to the hinged lid opening for removing and/or changing the screen 30. The platform is held in a fixed open position by means of the length of chain 68. The platform 60, as shown in phantom in FIG. 2, may be suitably held vertically in place out of the way when not in use, by means of a small pivoted bar element 69.

A suitable spring 70 coiled about the pivot or hinge shaft 56 and having its ends respectively secured to the lid or cover 54 and housing 66 enables one to move the mill's cover 54 easily from an open to a closed position and vice-versa.

The access door 72 to the hammermill portion 20 of the apparatus is hinged about a rod 74 suitably secured to the sides of the mill's housing 66. An upper stop bar 76 limits the upward travel of the door 72, which would generally be reached when one is processing a whole bale of hay (20 inches × 20 inches × 3 feet), as shown in phantom in FIG. 2. The bale of hay 78 is also shown in phantom in such illustration. With the counter-rotating augers 32, 34 having reverse screw flutes or flighting, rotating toward each other, such a bale of hay is generally maintained in a given centrally desired position on the auger feed table and is gradually fed into the hammermill unit. With augers rotating in the same direction, the hale or other grain, feed, etc. would tend to drag against the side or wall (80 or 82) of the feed trough inasmuch as it would be constantly urged thereagainst by the action of the augers, both of which would be rotating in a direction toward one or the other side of the feed trough.

A lid or cover lock, as best shown in FIG. 2, comprises a pivoted bar element 84 secured to an extension bar 85 attached to the rear wall 86 of the hammermill portion 20. Another extension bar 88, having a U-shaped bar clearance cutout 89, is secured to the lid or cover 54, and provides the means against which a threaded handle bar 90, engageable with the threaded bar element 84, may bear against so as to lock the cover 54 tightly against the housing 66 in a closed position. The cover lock (84 and 90) is also shown in phantom in FIG. 2, pivoted out of the way, thereby providing clearance for the lid or cover 54 to be rotated about its hinge or shaft 56; and suitable washers 92 are used to span the cutout clearance 89 are for providing the bearing surface upon which the handle bar 90 is tightened.

The apparatus is conveniently driven, as shown, from a power take-off (PTO) shaft 100 hooked up to a tractor PTO, as is well known in the art. The shaft 100 is suitably supported by bearing means 102 secured to the frame or platform structure. As shown in FIG. 3, a suitable V-belt 104 or belts connect and drive the rotor shaft 106 of the hammermill which is suitably supported at opposite ends of the housing 66, by means of bearings 108 and 110 supported on brackets 112 and 114, respectively.

Figure 7:
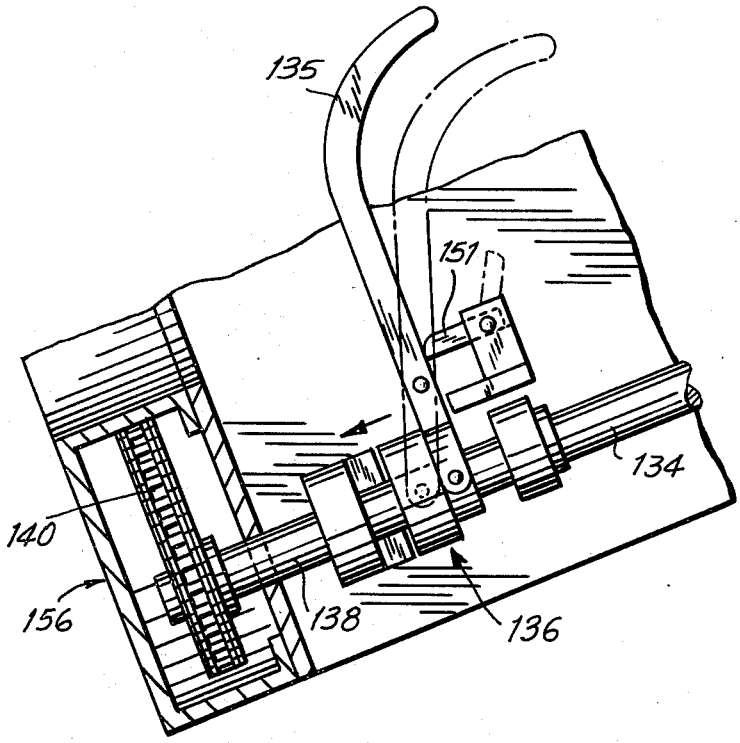
FIG. 7 is a fragmentary sectional view taken along the line 7—7 of FIG. 5.
Figure 6:
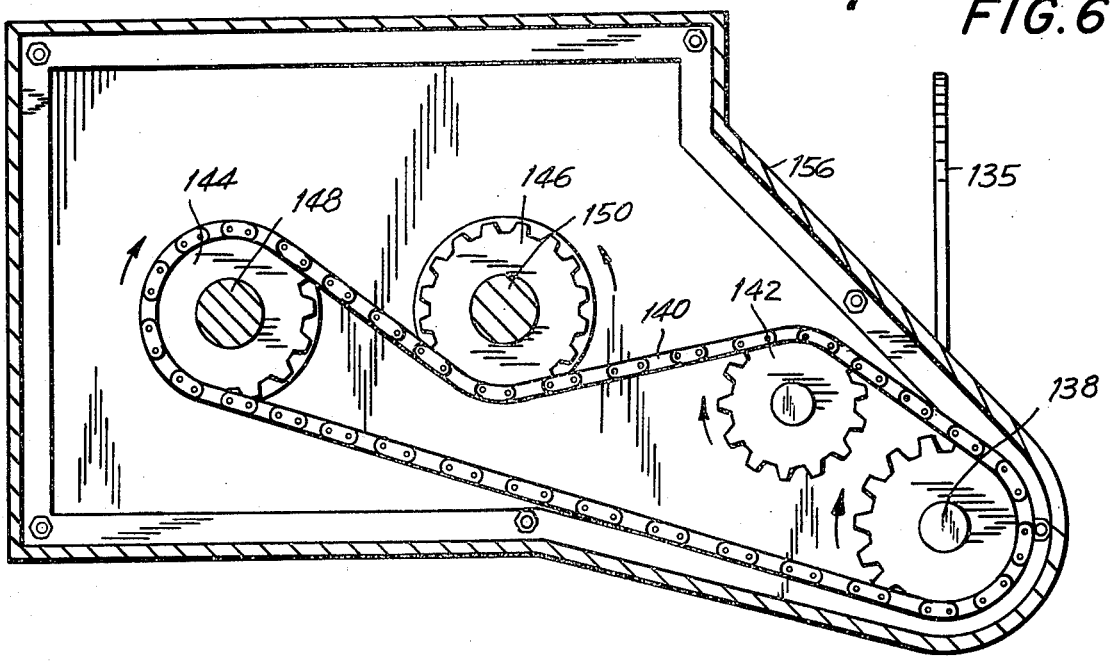
FIG. 6 is a sectional view generally taken along the line 6—6 of FIG. 5.

Another belt drive 116 extends from the end of the rotor shaft 106 to an intermediate drive shaft 118 by means of suitable pulleys 120 and 122. A suitable chain 124 and sprokets 126 and 128 drives another shaft 130, and by means of a suitable right angle gear box 132 and speed reducer or transmission, a drive shaft 134 is rotated thereby at a desired spin or speed. By moving a pivoted handle 135 against a manually operated mechanical keyway type of spring-loaded clutch means 136, the twin augers 32 and 34 are driven by drive shaft 138 suitably chain linked 140 about a suitable tension or idler sproket 142 to sprokets 144 and 146, respectively driving auger shaft 148 clockwise and auger shaft 150 counterclockwise, as best shown in FIGS. 6 and 7. A pivoted link 151 provides the necessary locking means to hold the clutch means disconnected during all "no-drive operations" of the augers.

Pairs of bearings 152 and 154 are used to provide spaced apart rotatable supports for the auger shafts 148 and 150, respectively. A suitable protective cover 156 encloses the auger drive chain system and another cover 158 enclosed the belt 116 and its pulleys 120 and 122. It will be recognized that by controlling the speed of the augers, the feed of the material may be likewise controlled into the hammermill.

Figure 5:
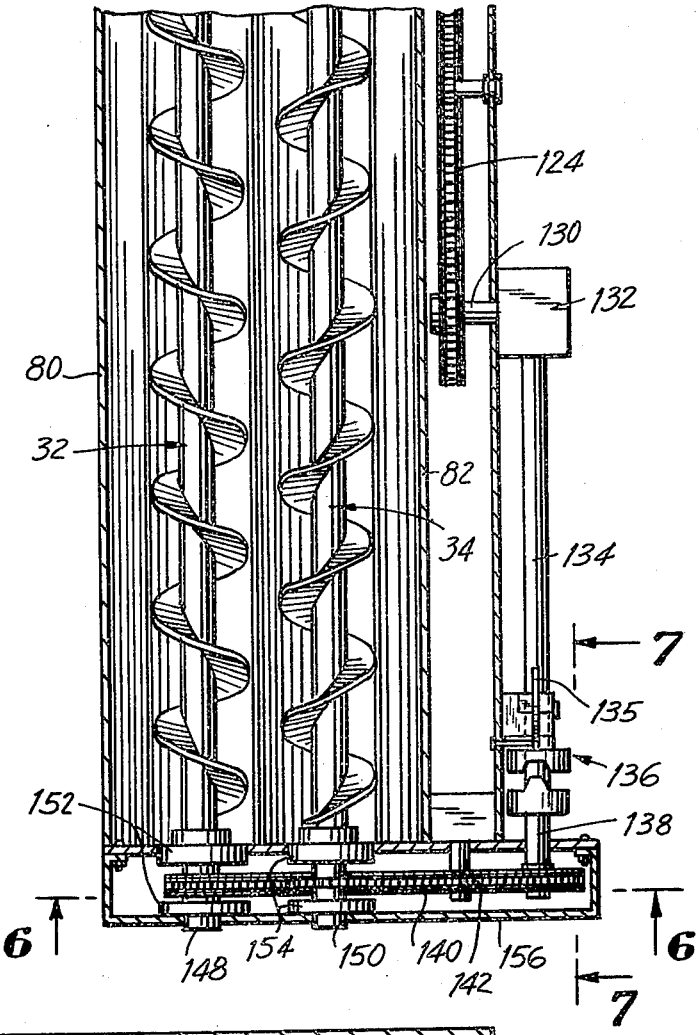
FIG. 5 is a partial plan view, looking down into the twin auger feed table, taken along the line 5—5 of FIG. 2.

The bottom of the twin auger table comprises a pair of troughs 160 and 162, respectively "seating" therein the augers 32 and 34. It will be appreciated that each auger is supported at the front or forward end by the pairs of bearings 152 and 154 (best shown in FIG. 5) and there associated supports so that the augers are generally not supported by the troughs into which they are situated or disposed.

Although not generally identified by reference numerals, directions of rotation of shafts, augers, etc. and direction of movements of a bale of hay 78, or the clutch means 136 is shown also by unmarked reference arrows.

Since the twin counter-rotating augers and their "moving" flutes or flighting feed the material to be processed directly into a hammermill turning clockwise (with augers on the right side when viewing), it is of critical importance that the material enter the hammermill at an angle of about 25° with respect to a horizontal line, as shown by the angle alpha (Greek letter) in FIG. 2. Such a preferred angle elevates the auger fed materials directly upwardly into the path of the hammermill rotor and thereby immediately commences processing of the materials against the screen by the hammers. A preferred angle range is from about 30° to about 20°. Such an angular elevation also facilitates feeding of the material to be processed into the trough or table of the twin augers, for example, by hand shoveling since the low end of the auger feed table is closest to ground or about knee high. Clearly, with such a low angled profile arrangement for the feed table, one can easily load the augers from ground level or from other automatic feeding machinery, such as belt systems or augers.

With the improved hammermill of the present invention embodying a screen of about 20° inch width and about 41½ inches long, feeding of material for maximum grinding efficiency is achieved with an auger table angle of about 25° feeding the material upwardly directly into the hammermill.

The auger table of the present invention, as is apparent from this application, is rigidly affixed to the housing of the hammermill and, consequently, it cannot be raised or otherwise pivoted or swung sideways along a limited arc of travel.

In FIG. 8, a modification of the improved hammermill is shown. As shown therein, a pair of the improved hammermills with their dual feed tables are conveniently mounted together on a frame in a back to back fashion so as to double the output therefrom as compared to a simple unitary apparatus having just a pair of counter-rotating augers in its single feed table.

As an example of a unit 14 is the "Mixing Apparatus for Fluent Material" disclosed and claimed in U.S. Pat. No. 3,129,927, granted Apr. 21, 1964 to A. D. Mast. This patent is also owned by the aforementioned common assignee. With such a typical mixing tank, or other well known mixing tanks, in combination with the apparatus of the present invention, the discharge or transfer auger may feed processed material directly into the mixing apparatus or tank. In the case of U.S. Pat. at No. 3,129,927, using the auger 16 (of the present application) one can transfer the fluent or processed material directly into the housing of the mixing tank or the housing enclosing an extension of the screw conveyor of such patented apparatus. Thus, the screw conveyor of said patent and the auger 16 of the invention herein can be the same item. Alternatively, the auger 16 can simply deposit the processed material in the hopper of said patent.

As another further analogous type of combination, the apparatus of the present invention can be combined with a garbage disposal unit or vehicle. For example, the present apparatus, which may be considered as a compactor inasmuch as it reduces to a desired uniform texture or grinds material to a predetermined size various bulk material, can also be coupled to a garbage device, truck or other vehicular type of apparatus. Thus, the hammermill apparatus provides the means by which the disposal unit or other device is capable of receiving compacted or processed material, for further processing or storage pending disposition or disposal at a further time or step in operation, as may be required in any further or subsequent processing or disposal of the material being handled by the combined apparatus.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefits of the teachings herein being intended to be reserved especially as they fall within the scope and breadth of the claims here appended.

What is claimed is:

1. A hammermill comprising a housing defining a grinding chamber having a rotor with a plurality of swinging hammers and a removable screen; an open material-receiving trough forming a feed table on one side of the housing; at least one pair of counter-rotating augers rotatively supported within said trough and flighting disposed about said augers for feeding material to be processed directly upwardly at an angle into the rotor and grinding chamber of said hammermill; said feed table rigidly affixed to said rotor housing and residing in a plane passing through the plane of said rotor, and means for rotating said rotor and said augers.

2. The hammermill according to claim 1, wherein each of said augers is rotatably supported at one end by means of a pair of bearings.

3. The hammermill according to claim 1, wherein said counter-rotating augers have reverse flighting comprising continuous oppositely disposed spiral flutes.

4. The hammermill according to claim 1, wherein said feed table is disposed at an angle between 20° and 30° with respect to a horizontal line.

5. The hammermill according to claim 1, wherein said feed table is disposed at an angle of approximately 25° with respect to a horizontal line.

6. The hammermill according to claim 2, wherein said counter-rotating augers have reverse flighting comprising continuous oppositely disposed spiral flutes.

7. The hammermill according to claim 3, wherein said feed table is disposed at an angle between 20° and 30° with respect to a horizontal line.

8. The hammermill according to claim 3, wherein said feed table is disposed at an angle of approximately 25° with respect to a horizontal line.

9. The hammermill according to claim 1, including at least one locking device for fixedly holding the screen at its upper end against the housing of the grinding chamber; said device comprising a bar element, secured to a cover disposed about said rotor, and having a hook at one end and threaded means at the opposite end thereof; said hook adapted to engage the top end of said screen, and said threaded means including means adapted to urge said hook tightly against said screen.

10. In combination with a mixing tank having a mixing chamber and at least one screw conveyor adapted to mix fluent material discharged into said tank; a hammermill apparatus comprising a housing defining a grinding chamber having a rotor with a plurality of swinging hammers and a removable screen; an open material-receiving trough forming a feed table on one side of the housing; at least one pair of counter-rotating augers rotatively supported within said trough and flighting disposed about said augers for feeding material to be processed directly upwardly at an angle into the rotor and grinding chamber of said hammermill; said feed table rigidly affixed to said rotor housing and residing in a plane passing through the plane of said rotor, means adapted to rotate said rotor and said augers, and transfer means for conveying said processed material from said hammermill to said mixing tank.

* * * * *